US007188708B2

(12) United States Patent
Osman

(10) Patent No.: US 7,188,708 B2
(45) Date of Patent: Mar. 13, 2007

(54) OIL PAN FOR AUTOMOBILE ENGINE

(75) Inventor: Azmi B. Osman, Johor (MY)

(73) Assignee: Petroliam Nasional Berhad, Kuala Lumpur (MY)

( * ) Notice: Subject to any disclaimer, the term of this patent is extended or adjusted under 35 U.S.C. 154(b) by 0 days.

(21) Appl. No.: 10/027,814

(22) Filed: Dec. 20, 2001

(65) Prior Publication Data

US 2002/0100641 A1 Aug. 1, 2002

(30) Foreign Application Priority Data

Dec. 21, 2000 (MY) ..... PI 2000 6077

(51) Int. Cl.
*F16N 31/00* (2006.01)

(52) U.S. Cl. ..... 184/106; 123/195 C

(58) Field of Classification Search ..... 184/1.5, 184/106; 123/195 C; 296/38; 126/51; 220/570, 220/571, 573, 4.12, 4.13, 4.14, 608; 99/444, 99/445; 62/285

See application file for complete search history.

(56) References Cited

U.S. PATENT DOCUMENTS

| | | | | | |
|---|---|---|---|---|---|
| 1,892,185 | A | * | 12/1932 | Clements | 184/106 |
| 2,437,013 | A | * | 3/1948 | Adams | 123/198 E |
| 2,577,188 | A | * | 12/1951 | Hall | 184/106 |
| 3,066,803 | A | | 12/1962 | Seils, Jr. | |
| 4,294,333 | A | | 10/1981 | Little | |
| 4,296,716 | A | * | 10/1981 | Hofbauer et al. | 184/106 |
| 4,395,982 | A | * | 8/1983 | Moller | 184/106 |
| 4,683,850 | A | | 8/1987 | Bauder | |
| 4,770,276 | A | * | 9/1988 | Takubo | 184/106 |
| 4,848,293 | A | * | 7/1989 | Sasada et al. | 184/106 |
| 4,986,235 | A | | 1/1991 | Ishii et al. | |
| 5,006,237 | A | | 4/1991 | Jones | |
| 5,054,442 | A | | 10/1991 | Pietsch et al. | |
| 5,058,545 | A | | 10/1991 | Hirai et al. | |
| 5,158,053 | A | | 10/1992 | Krechberger et al. | |
| 5,161,642 | A | | 11/1992 | Murakawa | |
| 5,291,863 | A | | 3/1994 | Jones | |
| 6,183,632 | B1 | * | 2/2001 | Covington | 210/168 |
| 6,332,556 | B1 | * | 12/2001 | Shalman | 220/570 |

FOREIGN PATENT DOCUMENTS

| | | | |
|---|---|---|---|
| EP | 0 269 054 B1 | | 6/1988 |
| FR | 2 721 975 A1 | | 1/1996 |
| JP | 08158845 A | * | 6/1996 |
| JP | 11280548 A | * | 10/1999 |

OTHER PUBLICATIONS

Search Report Dated Jun. 7, 2002 From Austrian Patent Office For Singapore Application No. 200107967-2 (3 pages).
Search Report Dated Apr. 2, 2002 From European Patent Office For European Application No. 01115661 (2 pages).

* cited by examiner

*Primary Examiner*—David Fenstermacher
(74) *Attorney, Agent, or Firm*—Dickinson Wright PLLC

(57) ABSTRACT

An oil pan for an engine, the oil pan having a plurality of substantially parallel, spaced-apart reinforcement channels (58) extending from adjacent a first end (10) of the oil pan to adjacent a second end (12) of the oil pan, each channel (58) having a base (58) and two sides (60) and an open top (66); the channels (58) tapering downwardly from the first end (10) and the second end (12) towards an accumulation area (24) of the oil pan.

17 Claims, 3 Drawing Sheets

OIL PAN FOR AUTOMOBILE ENGINE

CROSS-REFERENCE TO RELATED APPLICATION

This application is based upon and claims priority to Malaysian Patent Application No. P1 2000 6077, filed Dec. 21, 2000, which application is hereby expressly incorporated by reference.

FIELD OF THE INVENTION

This invention relates to an oil pan for an automobile engine and refers particularly, though not exclusively, to such an oil pan having increased strength.

BACKGROUND OF THE INVENTION

Oil pans are secured to the lower end of engine blocks of automobile engines, be they internal combustion (petrol) engines, or diesel engines. All engine oil settles in the pan when the engine is not running. Some of the oil is in the oil pan when the engine is running, the remainder being circulated to various components of the engine for lubrication of those components.

Although the oil pan is bolted to the lower end of the engine block, the oil pan plays a part in the inherent structural strength of the engine and powertrains, particularly in relation to powertrain bending resistance.

To manufacture an oil pan, three dies are normally used. The third die is at the transmission-end of the oil pan and is used to create large pockets in the material of the oil pan at the transmission end. The large pockets are required for access by the third die. The third die is required for the creation of the necessary components to enable the transmission to be attached, and for the creation of arcuate reinforcement structures.

To increase the structural strength of the oil pan, as well as increasing resistance to noise, vibration and harshness ("NVH"), requires use of non-flat surfaces. With the use of the third die, that is difficult to achieve.

It is therefore an object of the present invention to provide an oil pan for an engine, and which has increased structural strength.

A further object is to provide and oil pan for an engine that has improved resistance to noise, vibration and harshness.

Another object is to provide an oil pan for an engine which can be manufactured without the use of a third die.

SUMMARY OF THE INVENTION

With the above and other objects in mind the present invention provides an oil pan for an engine, the oil pan having a plurality of substantially parallel, spaced-apart reinforcement channels extending from adjacent a first end of the oil pan to adjacent a second end of the oil pan, each channel having a base and two sides and an open top; the channels tapering downwardly from the first end and the second end towards an accumulation area of the oil pan.

The reinforcement channels may be substantially U-shaped, or V-shaped. The angle of taper may be due to the channels being curved with a large radius of curvature such as 2000 mm.

The second end of the oil pan has an end surface that may be planar, and preferably has no tool access pockets therein.

Adjacent the second end and intermediate the width of the second end, the oil pan may have a region of reduced height.

The region of reduced height preferably has a planar portion into which the at least one reinforcing channel does not extend as the planar portion is to releasably receive thereon a horizontal portion of a substantially L-shaped cover plate. Similarly, the channels may not be in the accumulation area. The cover plate has a substantially upright portion such that when the cover plate is mounted on the planar portion, the substantially upright portion is substantially coplanar with the end surface. Preferably, the substantially upright portion has a securing flange at an end thereof remote from the horizontal portion.

DESCRIPTION OF DRAWINGS

In order that the invention may be readily understood and put into practical effect, there shall now be described by way of non-limitative example only a preferred construction of an oil pan incorporating the principal features of the present invention, the description being with reference to the accompanying illustrative drawings in which.

DESCRIPTION OF PREFERRED EMBODIMENT

Figure 1:
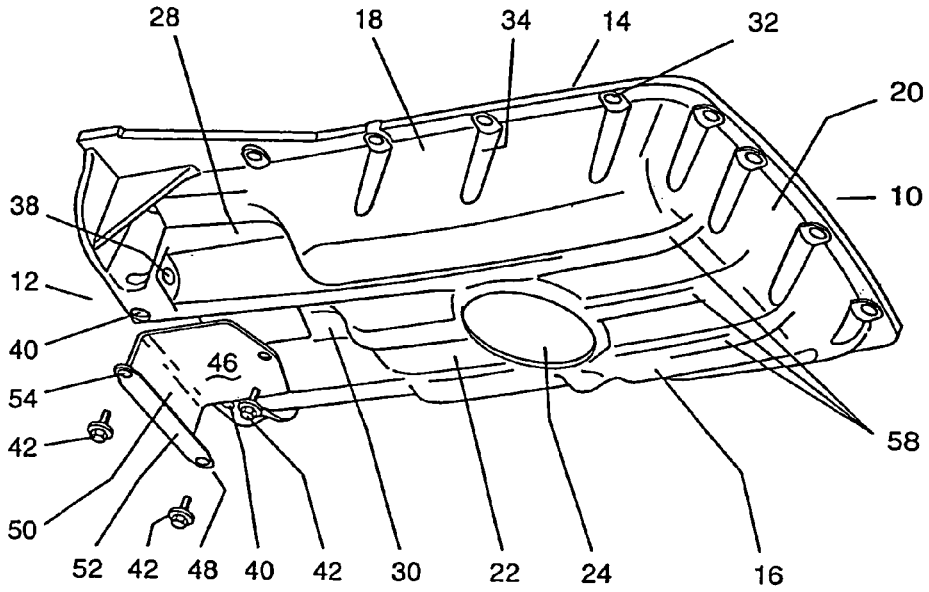
FIG. 1 is a perspective view of the oil pan from beneath and one end.
Figure 2:
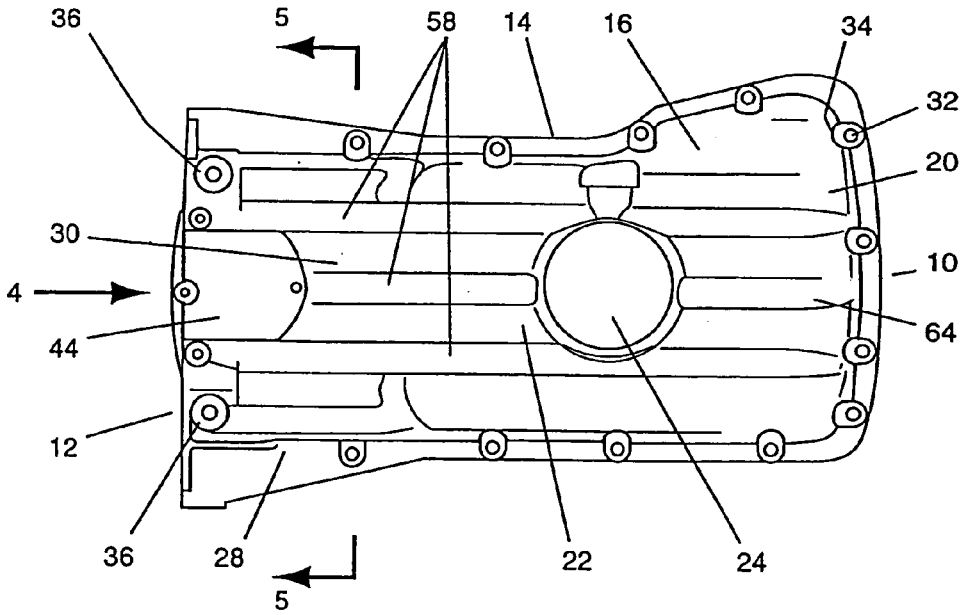
FIG. 2 is an underneath view of the oil pan.
Figure 3:
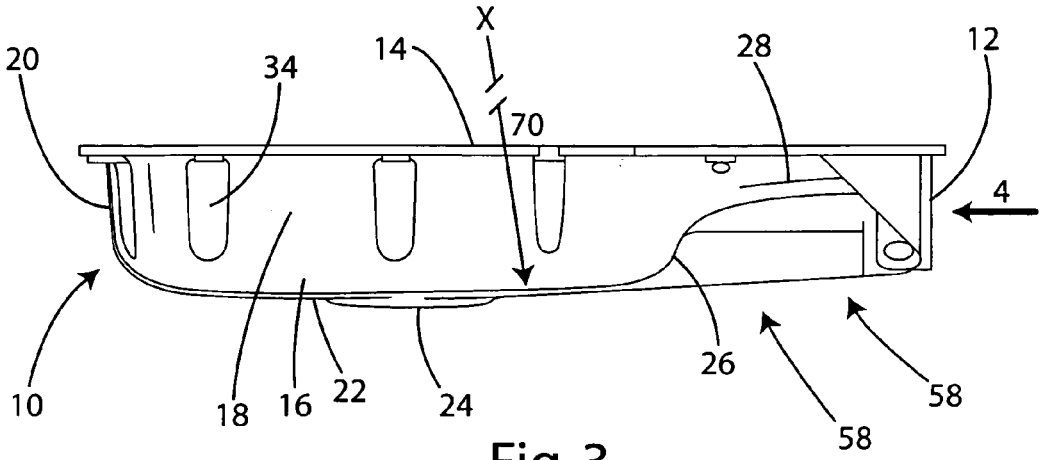
FIG. 3 is a side view of the oil pan.
Figure 4:
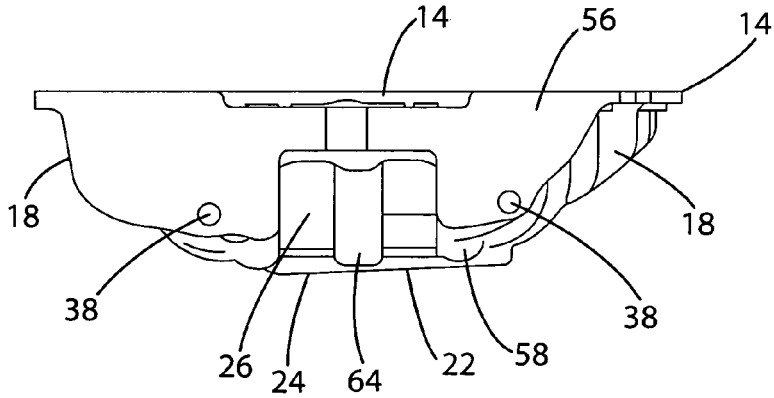
FIG. 4 is an end view of the oil pan from the direction of arrow 4 on FIGS. 2 and 3.
Figure 5:
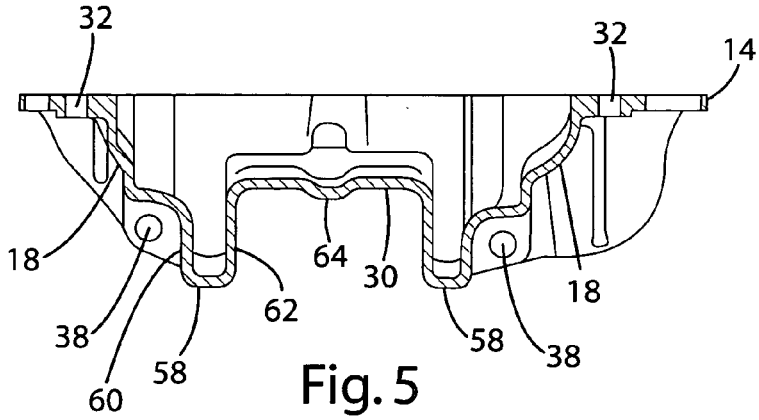
FIG. 5 is a vertical cross-section along the lines and in the direction of arrows 5—5 of FIG. 2.

The oil pan illustrated is for an engine such as an internal combustion engine. It has a first end 10, a second end 12, and a peripheral, securing flange 14. However, the flange 14 is non-continuous at second end 12. There is a main body 16 having side walls 18, a first end wall 20, base 22 and an accumulation area 24 into which oil will tend to drain. A second end wall 26 is provided and which tapers into a region 28 of reduced height. Region 28 has a floor 30 which, adjacent second end 12 and intermediate the length of second end 12, has a generally flat area 44.

Flange 14 has a plurality of bolt holes 32 therethrough. To enable reasonable access to those bolt holes 32, side walls 18 and first end wall 20 have concave recesses 34. Additional bolt holes 36 are provided to secure the oil pan in position, with bolt holes 38 being used to attach the oil pan to a transmission casing, and bolt holes 40 being for bolts 42 which are used to secure in place the horizontal portion 46 of an L-shaped cover plate 48. Cover plate 48 also has an upright portion 50 generally perpendicular to horizontal portion 46 and which, in turn, has an end flange 52 with bolt holes 54. Upright portion 50 does not have bolt holes, but horizontal portion 46 does have bolt holes.

Second end 12 has an end surface 56 which is generally planar. Perpendicular portion 50 is generally coplanar with end surface 56. Surface 56 has no openings therein as a third die is not required, and there is no major volume of material behind surface 56 requiring large pockets or openings to reduce weight, as in the past. Therefore, surface 56 can be more easily machined.

Extending longitudinally of the oil pan are a plurality, preferably three, reinforcing channels 58. Channels 58 extend from adjacent second end 12 to adjacent first end 10, although the centre channel 64 ceases before flat area 44, and at accumulation area 24.

Figure 6:
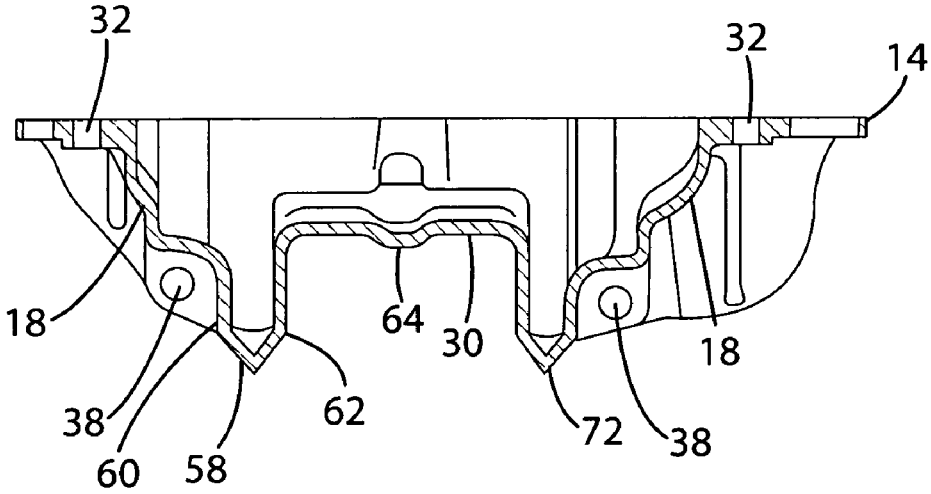
FIG. 6 is a vertical cross-section showing V-shaped chennels.

Each channel 58 is substantially U-shaped, having side walls 60, base 62, and an open top 66. Base 62 is, preferably, generally flat. However, as seen in FIG. 6, other shapes may be used such as, for example, a V-shape 72. The channels 58 preferably taper slightly from ends 10, 12 towards accumulation area 24 to encourage oil to flow to accumulation area 24. The taper may be by curving the channels along a large radius 70 such as, for example, 2000 mm. As can be seen, in region 28 the channels 58 are of significantly increased vertical height compared to that at base 22. Channels 58 continue up first end 10 but reduce in height to flange 14.

It is also to be noted that at second end 12 the usual "bridge" used to attach the oil pan to the transmission casing has also been eliminated. Channels 58 increase powertrain bending resistance, rigidity and torsional stress resistance. With the channels 58 extending from adjacent first end 10 to adjacent second end 12, flat surfaces are reduced, thus reducing NVH effects.

The channels 58 create small, flat areas. This tends to reduce NVH. By channels 58 having differing vertical heights, the oil pan has increased resistance to the various flexing forces on it from different causes such as, for example, the crankshaft, transmission, and so forth.

Adjacent the accumulation area 24 the channels 58 are of reduced vertical height to assist in minimising oil volume shift during lateral acceleration at, for example, 1 g. However, the channels 58 assist in oil flowing to accumulation area 24 due to the taper.

Furthermore, with the elimination of the use of a third die, the manufacturing operation can use a two die process. This reduces the cost and time taken for the making of tooling; simplifies machining requirements; lowers production costs, may reduce quality variation; and simplifies the machining of end surface 56.

Whilst there has been described in the foregoing description a preferred construction of an oil pan incorporating the principal features of the present invention, it will be understood by those skilled in the technology concerned that many variations or modifications in details of design or construction may be made without departing from the present invention.

The invention claimed is:

1. An oil pan for an engine comprising:

a plurality of substantially parallel, spaced-apart reinforcement channels continuously extending from adjacent a first end of the oil pan to adjacent a second end of the oil pan, each channel having a base and two sides and an open top, the channels extending downwardly from the first end and the second end wherein the oil pan has a region of reduced height and a main body between said first and second ends, the main body having two side walls, a first end wall, a second end wall and a base, the channels extending downwardly from the first end wall and the second end wall towards an accumulation area, and wherein the accumulation area is integral with the base and the channel sides along the base are of a height which is less than their height in the region of reduced height.

2. The oil pan of claim 1, wherein the reinforcement channels are substantially U shaped.

3. The oil pan of claim 1, wherein the reinforcement channels are V-shaped.

4. The oil pan of claim 1, wherein the second end of the oil pan has an end surface which is substantially planar.

5. The oil pan of claim 1, wherein there are no channels in the accumulation area.

6. The oil pan of claim 1, wherein said region of reduced height is adjacent the second end and intermediate the width of the second end and wherein the region of reduced height includes a planar portion into which at least one of said plurality of reinforcing channels do not extend.

7. The oil pan of claim 6, wherein the planar portion is adapted to releasably receive thereon a horizontal portion of a substantially L-shaped cover plate.

8. The oil pan of claim 7, wherein the cover plate has a substantially upright portion such that when the cover plate is mounted on the planar portion, the substantially upright portion is substantially coplanar with the end surface.

9. The oil pan of claim 8, wherein the substantially upright portion has a securing flange at an end thereof remote from the horizontal portion.

10. The oil pan of claim 7, wherein the cover plate has an upright portion, the upright portion having a securing flange at an end thereof remote from the horizontal portion.

11. The oil pan of claim 10, wherein the upright portion is substantially coplanar with the end surface.

12. The oil pan of claim 10, wherein a plurality of bolt holes are provided in each of the securing flange and the horizontal portion.

13. The oil pan of claim 12, wherein bolt holes are not provided in the upright portion.

14. The oil pan of claim 1, wherein the channels extending downwardly from the first end and the second end are created by curving the channels.

15. The oil pan of claim 14, wherein the channels have a radius of curvature that is 2000 mm.

16. The oil pan of claim 1, wherein the channels extend up the first end wall but at a reducing height up the first end wall.

17. The oil pan of claim 1, wherein there are three channels.

* * * * *

UNITED STATES PATENT AND TRADEMARK OFFICE

CERTIFICATE OF CORRECTION

PATENT NO. : 7,188,708 B2
APPLICATION NO. : 10/027814
DATED : March 13, 2007
INVENTOR(S) : Azmi B. Osman It is certified that error appears in the above-identified patent and that said Letters Patent is hereby corrected as shown below:

Column 1, line 7, "P1 2000 6077" should be --Pl 2000 6077--.

Column 2, lines 29 and 30, "chennels" should be --channels--.

Signed and Sealed this

First Day of May, 2007

JON W. DUDAS
*Director of the United States Patent and Trademark Office*

UNITED STATES PATENT AND TRADEMARK OFFICE

CERTIFICATE OF CORRECTION

PATENT NO. : 7,188,708 B2
APPLICATION NO. : 10/027814
DATED : March 13, 2007
INVENTOR(S) : Azmi B. Osman It is certified that error appears in the above-identified patent and that said Letters Patent is hereby corrected as shown below:

Column 1, line 7, "P1 2000 6077" should be --PI 2000 6077--.

Column 2, lines 29 and 30, "chennels" should be --channels--.

This certificate supersedes Certificate of Correction issued May 1, 2007.

Signed and Sealed this

Twenty-fifth Day of September, 2007

JON W. DUDAS
*Director of the United States Patent and Trademark Office*